US006595266B2

(12) United States Patent
Orii

(10) Patent No.: US 6,595,266 B2
(45) **Date of Patent: *Jul. 22, 2003**

(54) METHOD OF MANUFACTURING METALLIC SLURRY FOR CASTING

(75) Inventor: Shin Orii, Saitama-ken (JP)

(73) Assignee: Ahresty Corp., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/412,318

(22) Filed: Oct. 5, 1999

(65) Prior Publication Data

US 2001/0037869 A1 Nov. 8, 2001

Related U.S. Application Data

(63) Continuation of application No. 08/579,202, filed on Dec. 27, 1995, now abandoned.

(51) Int. Cl.[7] ..... B22D 30/00

(52) U.S. Cl. ..... 164/122; 164/127; 164/900; 420/590

(58) Field of Search ..... 164/122, 127, 164/900; 420/590

(56) References Cited

U.S. PATENT DOCUMENTS 4,738,712 A * 4/1988 Singer

FOREIGN PATENT DOCUMENTS

| | | | |
|---|---|---|---|
| EP | 0392998 | * 10/1980 | |
| JP | 1-192446 | * 8/1989 | ..... 164/900 |

* cited by examiner

*Primary Examiner*—Tom Dunn
*Assistant Examiner*—I.-H. Lin
(74) *Attorney, Agent, or Firm*—Dykema Gossett PLLC

(57) ABSTRACT

Molten aluminum alloy at a temperature between $T_l$ and $T_l$+60° C. is contacted with a cooling unit to form a semi-solid melt portion containing primary particles, and is maintained at a temperature between $(T_l-T_s)/2+T_s$ and $T_l$+40° C. by the cooling unit. The semi-solid melt portion is conveyed to a holding furnace where it is maintained at a solid-liquid coexisting temperature for a time that allows the primary particles to grow and stabilize in a globularized state.

4 Claims, 4 Drawing Sheets

METHOD OF MANUFACTURING METALLIC SLURRY FOR CASTING

CROSS-REFERENCE TO RELATED APPLICATION

This application is a continuation of application Ser. No. 08/579,202, filed Dec. 27, 1995, now abandoned.

FIELD OF THE INVENTION AND RELATED ART STATEMENT

This invention relates to a method of manufacturing metallic slurry for casting. More precisely, it relates to a method of manufacturing metallic slurry for casting, including metallic slurry for Rheocasting and metallic slurry for casting billets for Thixocasting, which is a semi-solidified metallic slurry in which metal in a molten state (liquid phase) and metal in a solid state (solid phase) coexist and fine grains are mixed with liquid.

This kind of metallic slurry needs to be maintained in a state in which primary grains are separated from each other (by liquid matrix), and their crystal grains must be fine, homogeneous and non-dendritic, desirably globular. Slurry itself in such a state, or billet made by continuous casting and rapid cooling of the slurry and reheated becomes semi-molten metal of a high fraction solid and low viscosity, which can restrain shrinkage porosities in a casting and also improve its mechanical properties.

Various attempts have been offered for this reason.

A technique close to this invention was published in Japanese Patent Laid-Open No. Sho61-235047.

In the conventional technique, molten metal was poured on a temperature-controlled, inclined plate to produce a semi-molten metallic slurry as it flowed down the plate. However, the crystal grains became rosaceous and could not be satisfactorily globularized.

OBJECT AND SUMMARY OF THE INVENTION

The object of this invention is to obtain metallic slurry for casting, particularly of aluminum alloys, and to offer a method of manufacturing such a slurry by which fine, homogeneous non-dendritic (globular) crystal grains can be obtained by means of simple facilities without requiring a complex process.

The method invented to achieve such an object is characterized by an arrangement to rapidly cool at least a portion of molten metal consisting of an aluminum alloy into a semi-solid state by putting the molten metal in contact with a cooling unit, and holding the molten metal within a semi-molten temperature zone for a given time. It is also characterized desirably by the adjustment of the temperature of the molten metal contacting the cooling unit between liquidus temperature $T_L$ and $T_L$+60° C., and also by the setting of the temperature of the molten metal at least a portion of which has been rapidly cooled into a semi-solid state between $(T_L-T_S)/2+T_S$ ($T_S$ represents solidus temperature) and $T_L$+40° C.

Further, it is characterized by an arrangement to make at least a portion of the molten metal contact a cooling unit by pouring and letting the molten flow on the cooling unit, which specifically is an inclined passage on which molten metal is poured and let to flow down, and the inclined passage is made in the shape of a plate, or gutter, or pipe.

DETAILED DESCRIPTION OF PREFERRED EMBODIMENTS

Figure 1:
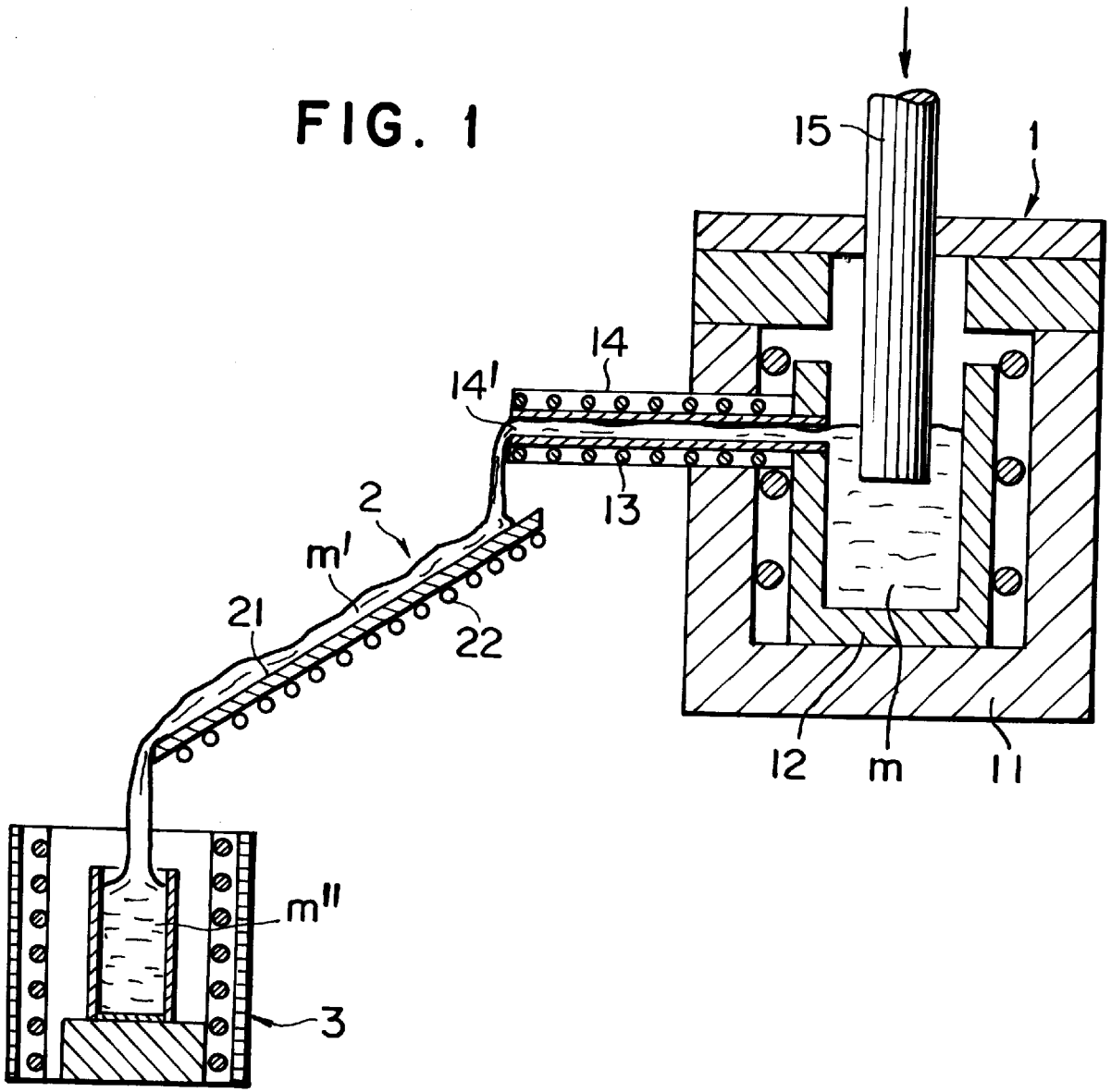
FIG. 1 is a schematic diagram showing an example of embodiment of this invention.

The method of manufacturing metallic slurry for casting which relates to this invention is described below with reference to the (schematic) shown in FIG. 1. This invention, however, is not limited to (such an embodiment).

In the figure, numbers 1, 2 and 3 denote a molten metal discharge furnace, a cooling unit, and a holding furnace, respectively.

The molten metal discharge furnace 1 is a furnace for accommodating and holding molten metal m of an aluminum alloy at a given temperature, or preferably at a temperature near the liquidus temperature, and it is composed of a well-known electric furnace 11 with a graphite crucible 12 inside, and a discharge feed pipe 14 equipped with a heater 13 and connected to the side thereof. Number 15 is a control rod to regulate the amount of discharged metal.

The cooling unit 2 is for rapidly cooling a portion of the molten metal m poured from the molten metal discharge furnace 1 into a semi-solid state by contact with the molten metal. It is made of a material, such as copper plate coated with solution resistant material, in the shape of a flat and smooth plate, or a gutter (split cylinder), or a pipe (cylinder), located directly under the feed hole 14' of the discharge feed pipe 14 in a sloping position to allow molten metal m to flow down, and providing an inclined passage 21 on its surface where molten metal m is poured to flow.

Number 22 in the figure is a cooling pipe to circulate a coolant, such as water, to control and maintain the surface of the cooling unit 2 at a given temperature.

The surface temperature of the cooling unit 2, or the inclined passage 21, is controlled depending on the pouring temperature and flow rate, etc., of molten m to prevent it from flowing to the holding furnace 3 without creating a semi-solid state, or otherwise to prevent it from stagnating as it freezes.

Specifically, the temperature of molten metal m' before being held in the holding furnace 3, or molten metal m' at least a portion of which has been rapidly cooled into a semi-solid state by contacting the cooling unit 2, is controlled with the cooling unit 2 between $(T_L-T_S)/2+T_S$ ($T_S$ denotes solidus temperature) and $T_L$+40° C. In this connection, if the temperature of molten metal is lower than $(T_L-T_S)/2+T_S$, the molten metal portion of which has been rapidly cooled into a semi-solid state ceases to flow on the cooling unit 2. If it becomes higher than $T_L$+40° C., the structure of metal m' held in the holding furnace 3 ends up as an undesirable structure which has grown dendritically.

By controlling the temperature of molten metal m' rapidly cooled by contact with the cooling unit 2 between $(T_L-T_S)/$ $2+T_S$ and $T_L+40°$ C., the structure of the molten metal m' when plunged into ice water (or the like) and quenched becomes a very fine, granular structure even at liquids $T_L+\alpha$ ($\alpha$ below 40 degree C.), whereas it was confirmed in an experiment that at the same (liquidus+$\alpha$) the structure of molten metal not contacting the cooling unit 2 does not become granular, but fine, dendritic when plunged into ice water or the like and quenched at the same liquidus $T_L+\alpha$.

In this invention, the temperature of molten metal m at the same time it contacts the inclined passage 21 of the cooling unit 2 is adjusted between liquidus $T_L$ and $T_L+60°$ C. When the temperature of molten metal m is below liquidus $T_L$, it is difficult to control the cooling unit 2 and prevent molten metal m' from ceasing to flow on the inclined passage 21 of the cooling unit 2. When it is above $T_L+60°$ C., it is also difficult to keep the semi-solid state of a portion of molten metal m' which has been put into contact with the surface of the inclined passage 21 of the cooling unit 2.

The holding furnace 3 is for getting the primary grains to grow and stabilizing the globularized state of molten metal m' at least a portion of which is in a semi-solid state, or has crystallized primary grains, by holding the molten metal m' at solid-liquid coexisting temperature for a given time.

For instance, a well-known electric furnace is used for the holding furnace 3.

When molten metal m in the molten metal discharge furnace 1 is poured through the discharge feed pipe 12 and let to flow down the inclined passage 21 of the cooling unit 2 after the molten metal temperature is adjusted between liquidus temperatures $T_L$ and $T_L+60°$ C., at least a portion of the molten metal m is rapidly cooled into a semi-solid state. And when the temperature of the molten metal m' rapidly cooled into a semi-solid state is controlled between $(T_L-T_S)/2+T_S$ and $T_L+40°$ C., by means of the cooling unit 2 and the molten metal is held in the holding furnace 3 within the semi-molten temperature zone ($T_S$~$T_L$) for a given time, good metallic slurry m' with globular primary grains is obtained.

In an experiment, it was found that the holding time in the semi-molten metal temperature zone ($T_S$~$T_L$) in the holding furnace 3 is desirably 15 seconds or more; with an increase in the holding time, metallic slurry with more stabilized state of globularization was obtained.

[Embodiment]

Figure 2:
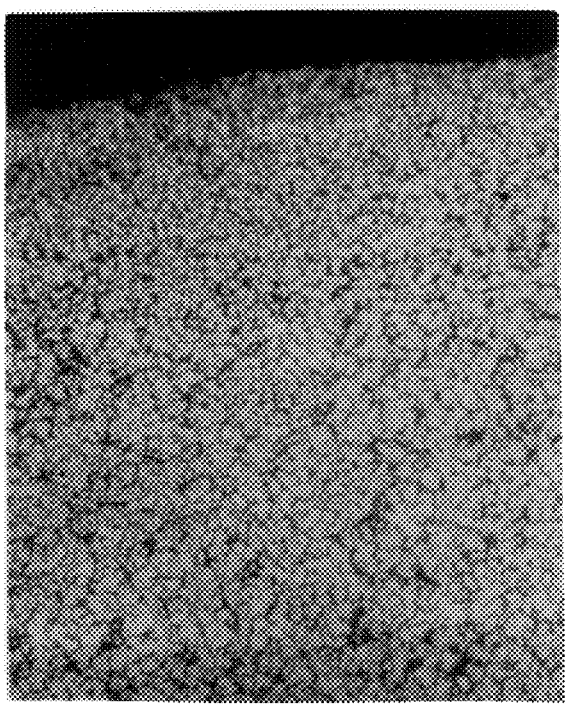
FIG. 2 is a microscopic picture of the structure of molten metal m' of which a portion has been quenched into a semi-solid state relating to an example of embodiment of this invention.

Aluminum alloy AC4C of JIS was used for molten metal m, and the molten metal temperature at the time of contact with the surface of the inclined passage 21 of the cooling unit 2 and the temperature of molten metal m' a portion of which was rapidly cooled into a semi-solid state were set at 644° C. (liquidus temperature+30° C.) and 634° C. (liquidus temperature+20° C.) respectively. The obtained molten metal m', a portion of which had been rapidly cooled into a state of semi-solid state, was plunged into ice water and quenched. A microscopic picture of the structure of the metal is shown in FIG. 2.

In this microscopic picture, the white section is primary grains. If molten metal do not contact the cooling unit 2, the structure becomes fine-grained, but dendritic. It is observed that the molten-metal which contacted the cooling unit 2 formed a granular structure.

Figure 3:
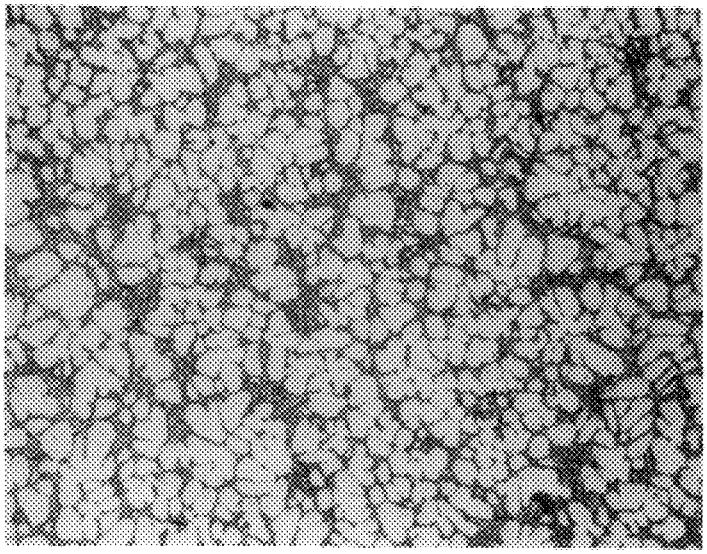
FIG. 3 is a microscopic picture of the structure of metallic slurry relating to an example of embodiment of this invention.

Then, by holding the molten metal m', a portion of which had been rapidly cooled, into a semi-solid state in the holding furnace at 577° c. for one minute, metallic slurry m" was obtained. A microscopic picture of the structure of the metallic slurry m" which was plunged into ice water and quenched is shown in FIG. 3.

It is observed in this microscopic picture that the primary grains have grown in good, globular crystals. In the same picture, the white section was the primary grains (solid phase) when the metal was in slurry, and the black section was the molten portion when the metal was in slurry. This applies to the following microscopic pictures of metal structures.

Figure 4:
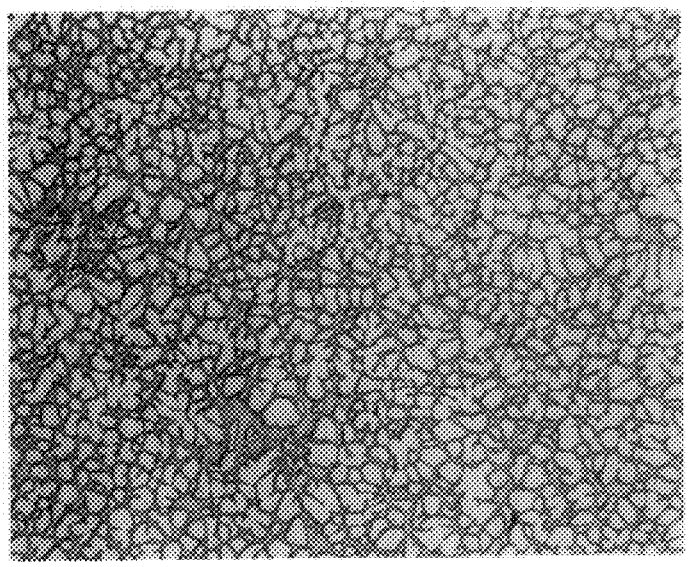
FIG. 4 is a microscopic picture of a billet made from metallic slurry related to an example of embodiment of this invention.

For reference sake, a microscopic picture of the structure of a biller which was made by continuous casting of the metallic slurry m" is shown in FIG. 4. It is observed in this picture that the primary grains consist of good, globular crystals.

[Comparison]

Metallic slurry m" was obtained by using the same molten metal as in the above-mentioned embodiment, and setting the temperature of molten metal at the time of contacting the surface of the inclined passage 21 of the cooling unit 2 at 684° C. (liquidus temperature+70° C.) and the temperature of molten metal m' a portion of which had been rapidly cooled into a semi-solid state at 654° C. (liquidus temperature+40° C.), and holding it in the holding furnace 3 at 577° C. for one minute.

Figure 5:
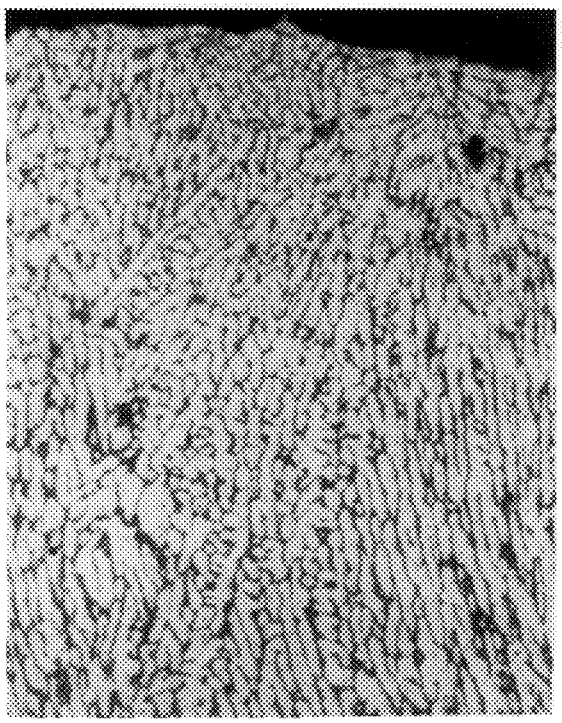
FIG. 5 is a microscopic picture of the structure of molten metal a portion of which was quenched into a semi-solid state for comparison purpose.
Figure 6:
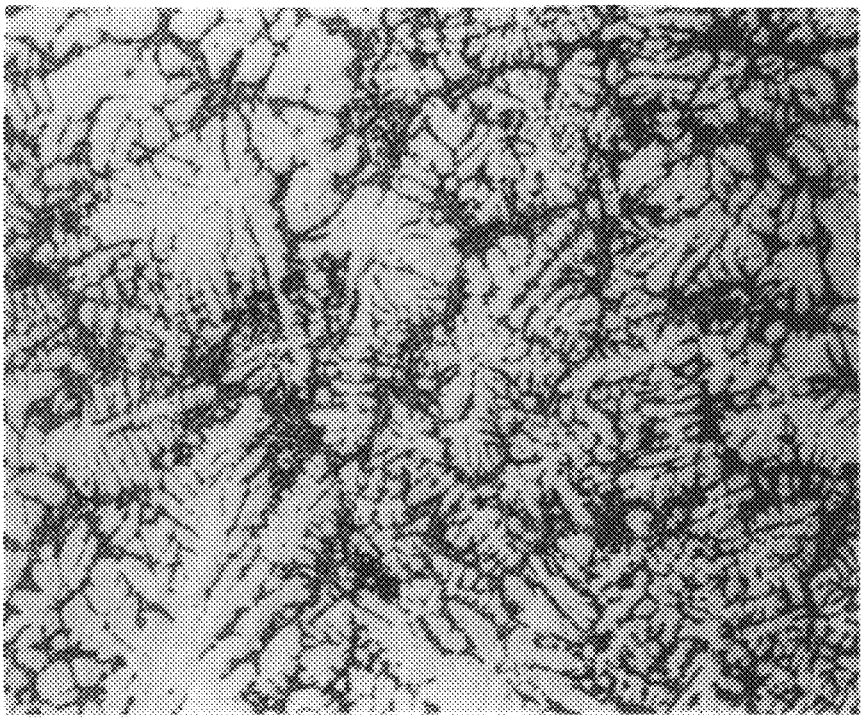
FIG. 6 is a microscopic picture of the structure of metallic slurry for comparison purpose.

FIGS. 5 and 6 show microscopic pictures of the structures of the molten metal m' a portion of which had been rapidly cooled into a semi-solid state and the metallic slurry m", which were both obtained under the above setting, and plunged into ice water and quenched as in the foregoing embodiment.

It can be seen from these microscopic pictures that primary grains have grown in dendritic crystals.

As described above, with the method relating to this invention of manufacturing metallic slurry for casting, fine-grained, nearly homogeneous non-dendritic (globular) primary grains can be obtained without the need of a complex process but with simple facilities.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope and spirit of the invention as defined by the appended claims.

What is claimed is:

1. A method of producing a metallic aluminum slurry for casting from an aluminum alloy which has a solidus temperature, $T_S$, and a liquidus temperature, $T_L$, comprising the steps of:

(a) providing molten aluminum alloy m;

(b) contacting said molten aluminum alloy m at a temperature between $T_L$ and $T_L+60°$ C. with a cooling unit to change the temperature of the molten aluminum alloy m to between $(T_L-T_S)/2+T_S$ and $T_L 40°$ C. so as to provide semi-condensed aluminum alloy slurry m' quenched to a semi-solid state containing primary particles; and c) maintaining said semi-solid state metallic slurry m' at a semi-melting temperature between $T_S$ and $T_L$ at least 15 seconds in duration.

2. A method of manufacturing metallic slurry for casting as defined in claim 1, wherein an arrangement makes at least a portion of the molten metal contact the cooling unit by pouring and letting the molten metal (m) flow on the cooling unit.

3. A method of manufacturing metallic slurry for casting as defined in claim 1, wherein the cooling unit is an inclined passage on which molten metal is poured and flows down.

4. A method of manufacturing metallic slurry for casting as defined in claim 3, wherein the inclined passage is in the shape of a plate, gutter or pipe.

* * * * *